United States Patent [19]

Higgins

[11] 4,063,401

[45] * Dec. 20, 1977

[54] BAGGING MACHINE

[76] Inventor: David M. Higgins, 1748 N. Drury Lane, Arlington Heights, Ill. 60004

[ * ] Notice: The portion of the term of this patent subsequent to Aug. 5, 1992, has been disclaimed.

[21] Appl. No.: 658,743

[22] Filed: Feb. 17, 1976

Related U.S. Application Data

[62] Division of Ser. No. 508,876, Sept. 24, 1974, Pat. No. 3,944,045, which is a division of Ser. No. 393,588, Aug. 31, 1973, abandoned.

[51] Int. Cl.[2] ..... B65B 43/08

[52] U.S. Cl. ..... 53/183

[58] Field of Search ..... 53/180 M, 182 M, 183, 53/386, 184 S, 187

[56] References Cited

U.S. PATENT DOCUMENTS

| | | | |
|---|---|---|---|
| 3,621,638 | 11/1971 | Grocke | 53/183 X |
| 3,735,557 | 5/1973 | Hoffart et al. | 53/183 |
| 3,852,937 | 12/1974 | Bitsura | 53/184 S X |
| 3,897,674 | 8/1975 | Higgins | 53/183 X |

FOREIGN PATENT DOCUMENTS

| | | | |
|---|---|---|---|
| 1,274,576 | 5/1972 | United Kingdom | 53/184 S |

*Primary Examiner*—Travis S. McGehee
*Assistant Examiner*—John Sipos
*Attorney, Agent, or Firm*—Henry L. Brinks; Peter E. Heuser

[57] ABSTRACT

A bagging machine for automatically covering a loaded pallet with a bag formed from a tubing of material such as heat-shrink film. The tubing is fed by drive rollers to a pair of inclined vacuum belt units which open the tubing and pass it downward to gathering arm assemblies. The tubing is collected on the gathering arm assemblies until the appropriate length of bag has been fed by the driver rollers. A cut-and-seal mechanism then cuts the tubing and seals the end of the bag. The belt units complete the feeding of the bag onto the gathering arm assemblies and the assemblies are lowered over the loaded pallet. The bagging machine also includes means for automatically centering the loaded pallet under the belt units.

9 Claims, 20 Drawing Figures

FIG. 7
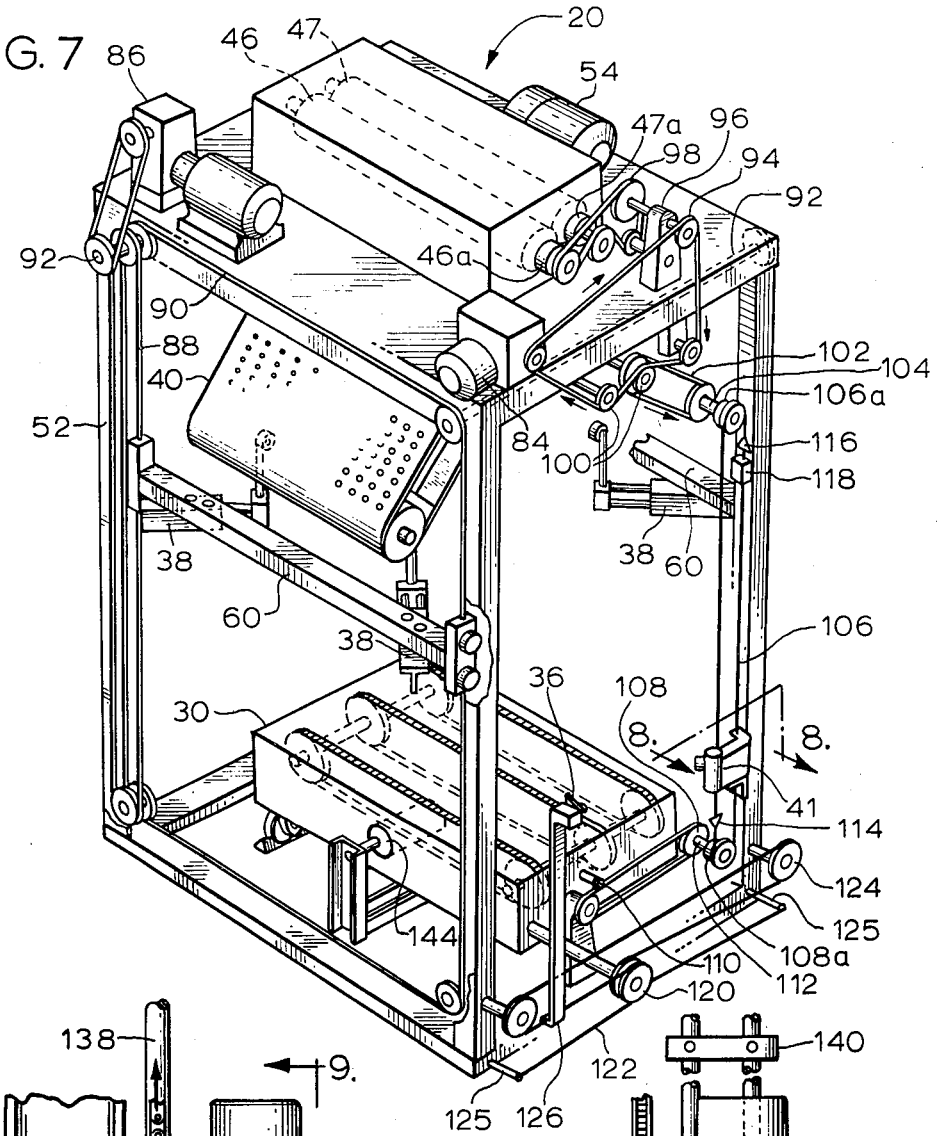
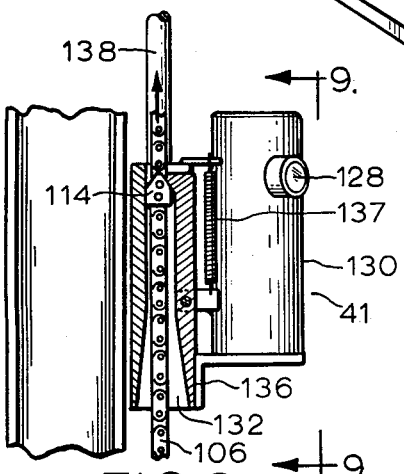
FIG. 8
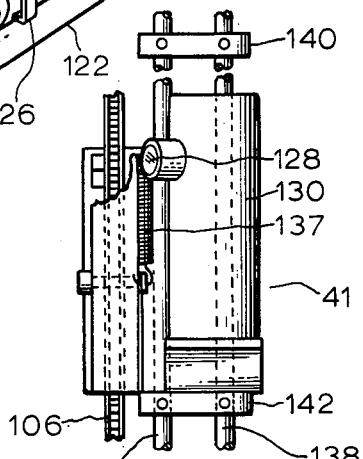
FIG. 9

FIG. 10
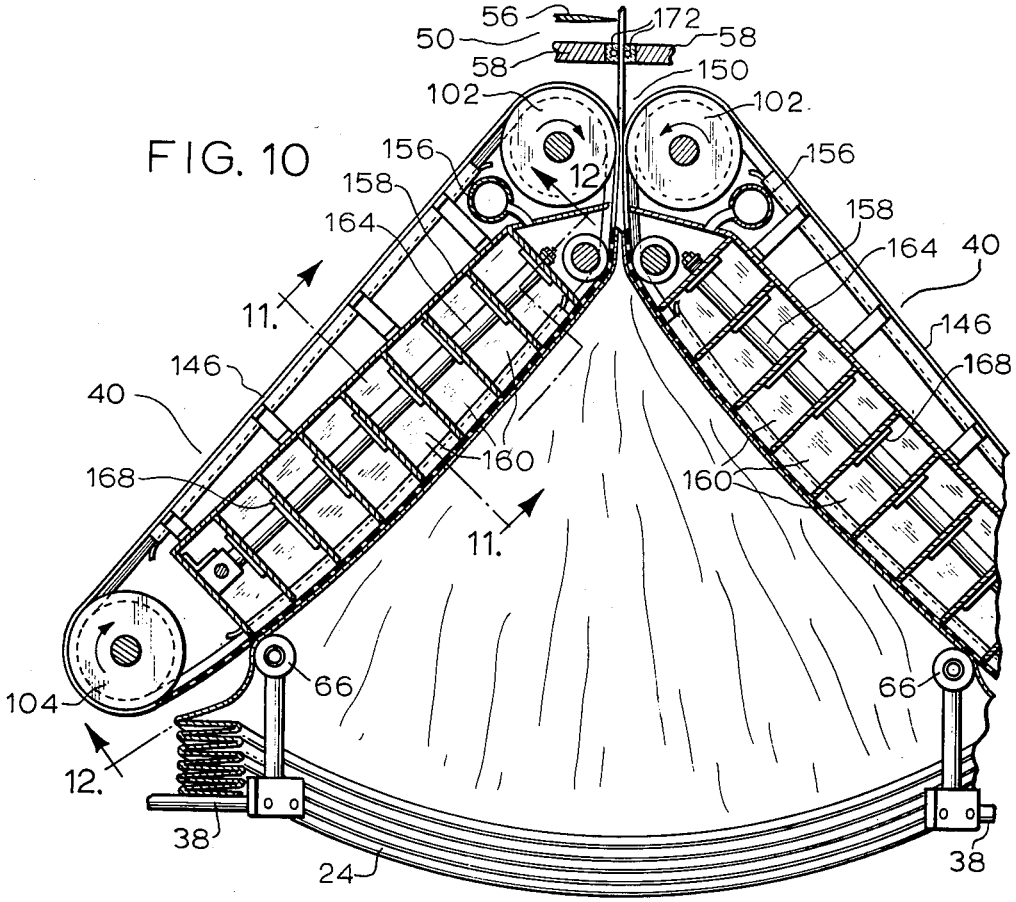
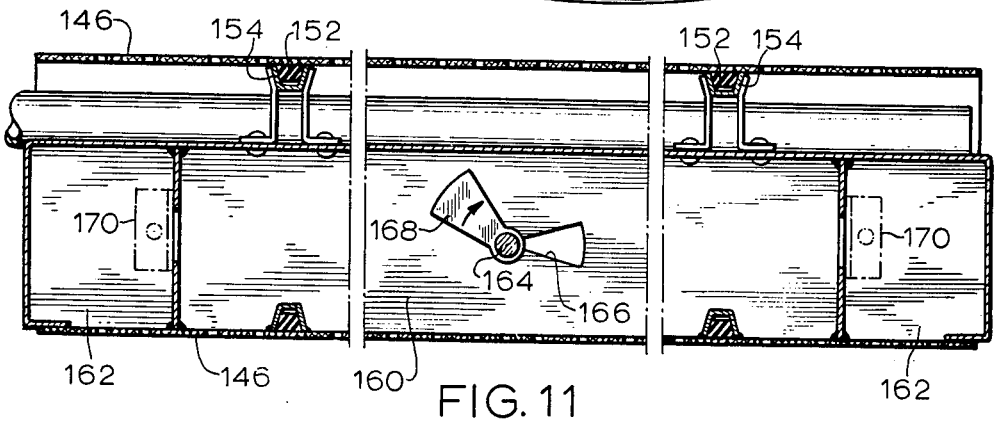
FIG. 11

BAGGING MACHINE

This is a division of application Ser. No. 508,876, filed Sept. 24, 1974 now U.S. Pat. No. 3,944,045, which is a division of application Ser. No. 393,588, filed Aug. 31, 1973, now abandoned in favor of continuation Ser. No. 511,199 now U.S. Pat. No. 3,897,674.

The invention relates to a bagging machine for automatically placing a bag of heat-shrink film over a load. More particularly, the invention relates to a bagging machine for automatically placing a bag of heat-shrink film over a loaded pallet having varying dimensions. The bagging machine operates to center the pallet being loaded within the machine for placement of the bag over the loaded pallet. The bagging machine selects either a large or small diameter tubing for forming a bag to cover the loaded pallet depending upon the size of the pallet being covered with the bag. The use of either a large and a small diameter bag allows pallets having a wide range of size variation to be covered with the bag. The bagging machine forms the bag from the tubing that has been selected for the particular size pallet.

The bagging machine includes inclined vacuum belt units which are used to draw open the sides of the bag and move the sides of the bag along the belt unit onto a gathering arm means. This step continues until the bag is collected upon the gathering arm means. The gathering arm means is then retracted to a position depending upon the size of the bag and the bag is lowered over the loaded pallet.

Accordingly, it is a feature of the present invention to provide a bagging machine for automatically covering a loaded pallet with a bag where the pallets are of varying dimensions. Also, it is a feature of the present invention to provide means for automatically centering the varying sized pallets within the bagging machine for the bagging operation.

It is another feature of the invention to provide means for sensing the size of the loaded pallets and determining which of varying sizes of bagging material are to be used to form a bag covering the pallet.

It is another feature of the invention to provide means for determining the length of the bag which is necessary to cover the varying sized pallets.

It is another feature of the invention to detect the length of the pallet and determine the peripheral size of the bagging material which is appropriate to form the bag.

It is another feature of the invention to provide a centering trolley for automatically centering varying sized pallets within the bagging machine.

It is another feature of the invention to provide an inclined vacuum belt unit for opening the bag and placing it upon a gathering arm assembly for lowering over the pallet.

Other features of the invention will become apparent from a review of the detailed description and the drawings. One form of the invention is demonstrated in the drawings in which:

FIG. 1 is a diagrammatic view of a bagging machine embodying the present invention;

FIGS. 2*a*, 2*b*, 2*c* and 2*d* are schematic diagrams illustrating the operation of the bagging machine;

FIG. 7 is a perspective view of the bagging machine showing the drive train mechanisms used in the machine;

FIG. 8 is a detailed view of the bag length sensor used in the bagging machine taken along line 8—8 in FIG. 7;

FIG. 9 is a side view of the bag length sensor taken along line 9—9 in FIG. 8;

FIG. 10 is a sectional view of the vacuum belt units utilized in the bagging machine;

FIG. 11 is a sectional view of the vacuum belt unit taken along line 11—11 in FIG. 10;

Figure 15:
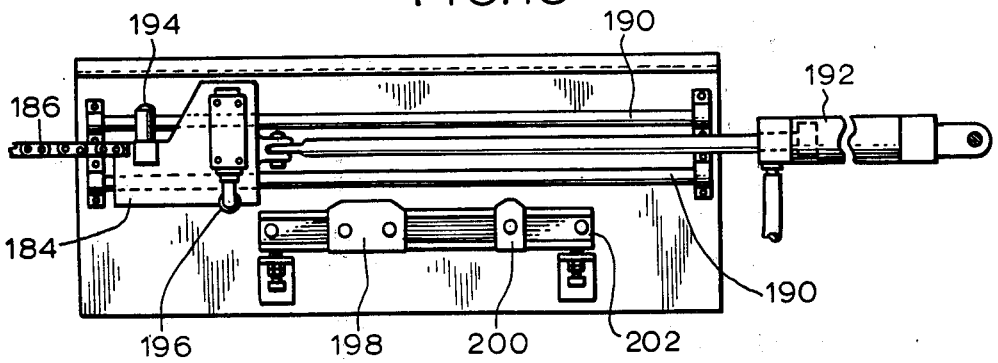
Figure 13:
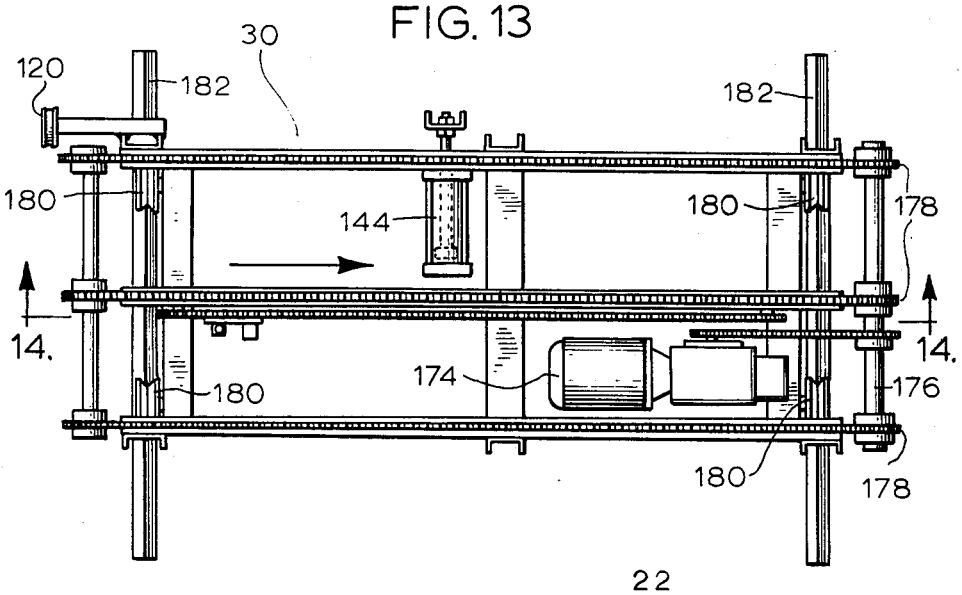
FIG. 13 is a top view of a centering trolley utilized in the bagging machine.
Figure 14A:
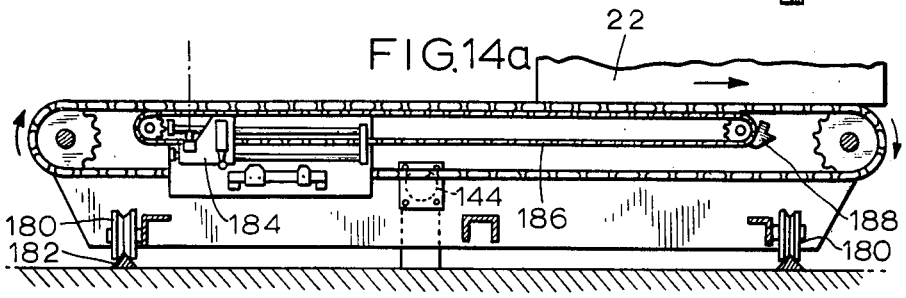
Figure 14B:
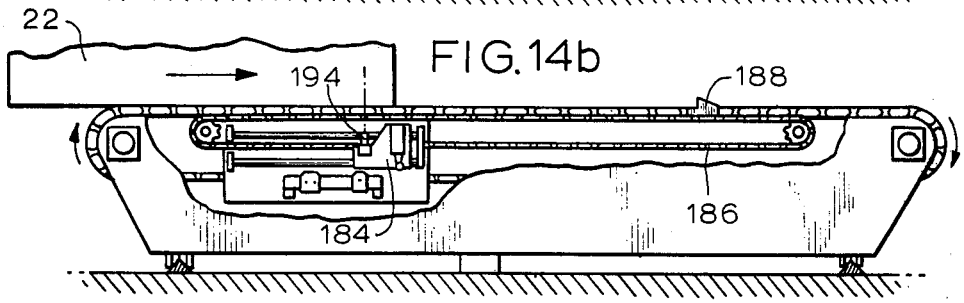
Figure 14C:
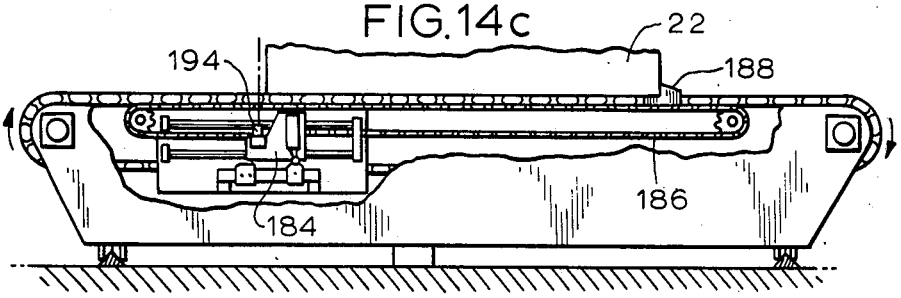

FIG. 14*a*, 14*b* and 14*c* are sectional views taken along line 14—14 in FIG. 13 showing the stages of operation of the centering trolley in centering a pallet on the trolley; and FIG. 15 is a detailed view of a portion of the centering mechanism associated with the centering trolley.

Figure 1:
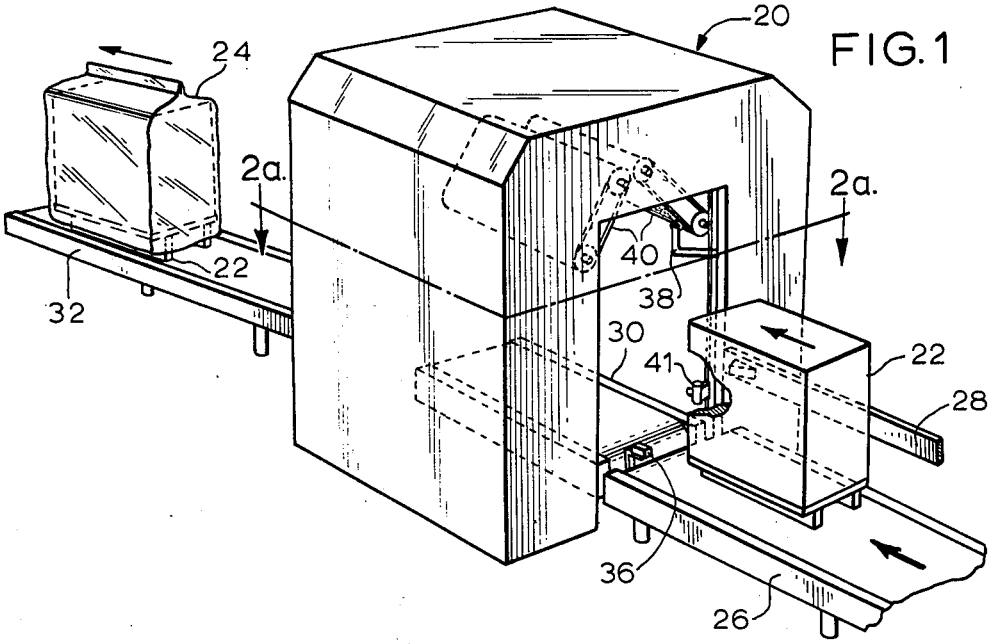

Referring to FIG. 1, a bagging machine embodying the present invention is indicated generally by the numeral 20. The bagging machine 20 receives a loaded pallet 22 and places a bag 24 of heat-shrinkable film over the pallet. The bagging machine 20 automatically centers the loaded pallet 22 in the machine and selects an appropriate peripheral size and length of bag for the varying shape of the loaded pallet 22.

The loaded pallet 22 is presented to the bagging machine 20 by an entrance conveyor 26 that biases the loaded pallet 22 toward a guide rail 28. The loaded pallet 22 is automatically placed in a centered position within the bagging machine 20 by a centering trolley 30. A bag 24 of heat-shrinkable film is then placed over the loaded pallet 22 by the bagging machine. The loaded pallet 22 covered with a bag 24 then is transferred by the centering trolley 30 from the bagging machine 20 to a discharge conveyor 32. The loaded pallet 22 which is covered with the bag 24 is then presented to a heating device to shrink the bag 24 around the loaded pallet 22. The heating device may be coupled to the discharge conveyor 32 and operate automatically in conjunction with the bagging machine 20. Also, the heat shrinking operation can be undertaken as a separate step.

Figure 2A:
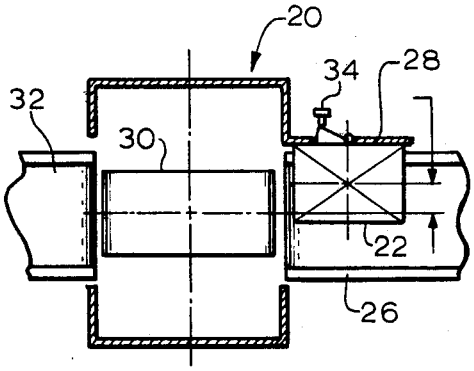
Figure 2B:
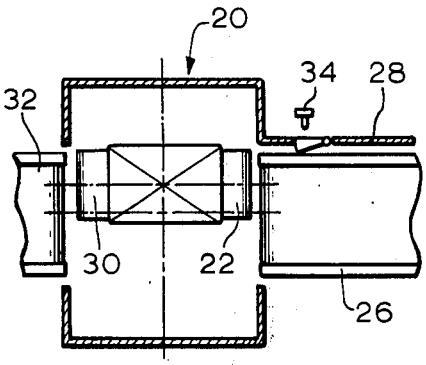

Referring to FIGS. 2*a*, 2*b*, 2*c* and 2*d*, the operation of the bagging machine 20 in placing a bag over a loaded pallet will be described. The loaded pallet 22 is presented by the conveyor 26 at the entrance of the bagging machine 20 against the guide rail 28. In this position, a limit switch 34 is activated to signal the presence of the loaded pallet to the bagging machine 20. The centering trolley 30 moves from its home position at the center of the bagging machine 20 toward the longitudinal center line of the loaded pallet 22. When the longitudinal center line of the trolley is centered with the longitudinal center line of the loaded pallet 22, the side sensor 36 contacts the side of the loaded pallet to signal that the centering trolley is in a centered position. As shown in FIG. 2*b*, the loaded pallet 22 is then automatically loaded onto the centering trolley 30 until the lateral center line of the pallet coincides with the lateral center line of the bagging machine. The centering trolley 30 is then returned to the home position in the bagging machine 20.

Figure 2C:
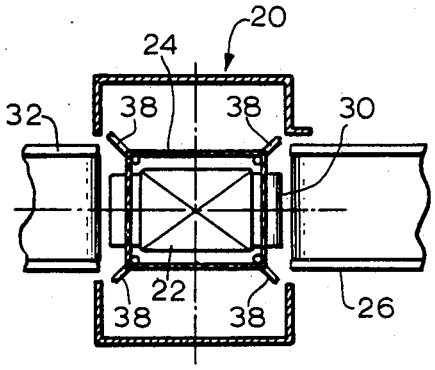
Figure 2D:
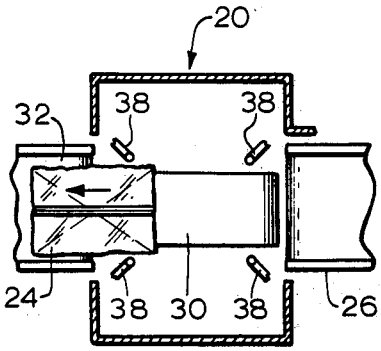

As depicted in FIG. 2*c*, the bag 24 is placed on gathering arm assemblies 38 by inclined vacuum belt units 40. The bag 24 is formed from a gusseted tubing of heat-shrinkable film associated with the bagging machine 20, as detailed. The tubing is fed by the vacuum belt units 40 onto the gathering arm assemblies 38 until a bag length sensor 41 indicates that the appropriate length of bag has been collected. A cut-and-seal mechanism then severs the tubing and seals the end thereof to form the bag 24. The gathering arm assemblies 38 are next lowered over the loaded pallet 22 to arrange the bag 24 about the loaded pallet. As illustrated in FIG. 2*d*, the loaded pallet 22 and bag 24 are next transferred by the centering trolley 30 onto the discharge conveyor 32.

Figure 3:
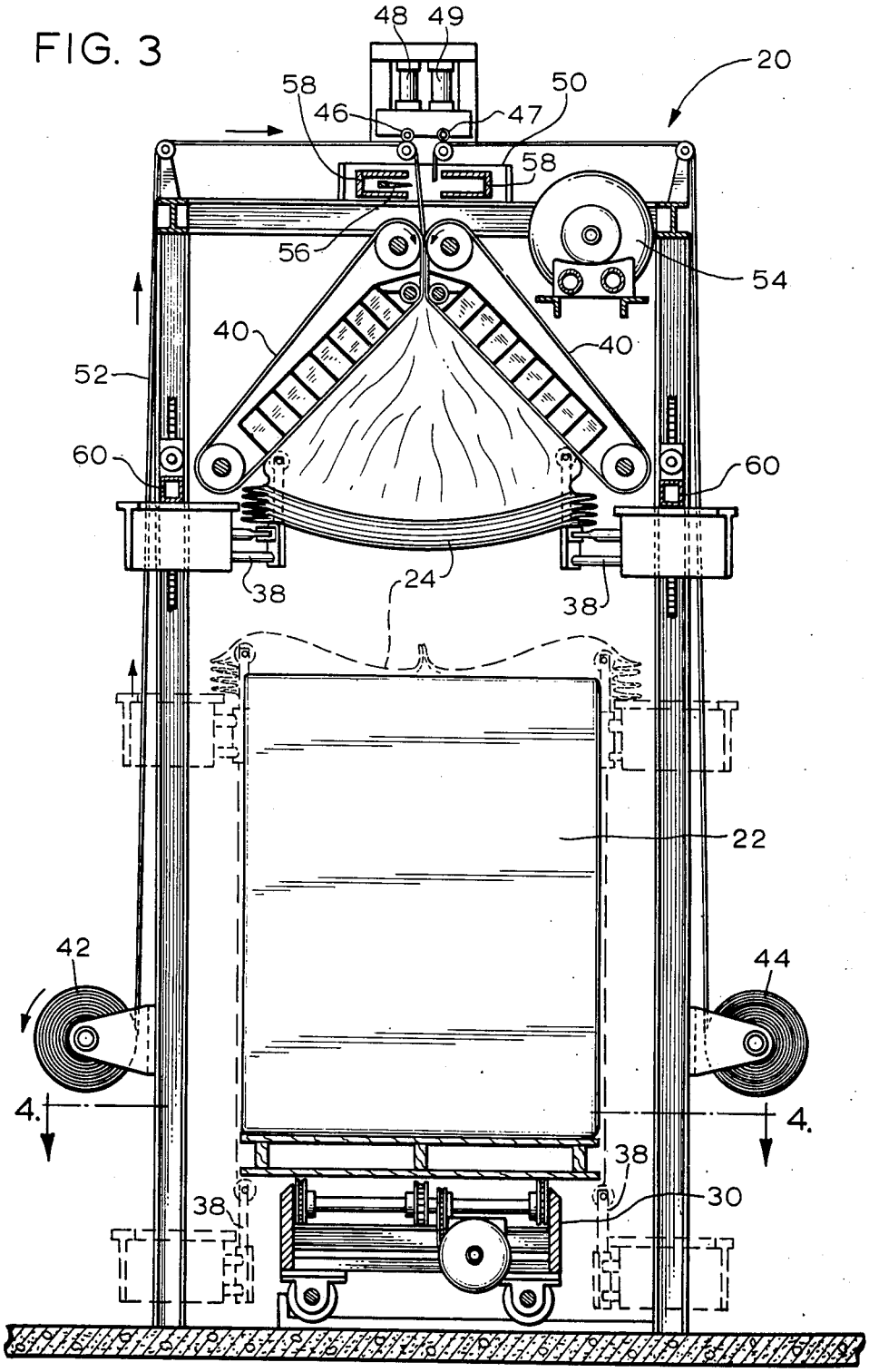
FIG. 3 is a sectional view of the bagging machine taken along a vertical plane.

Referring to FIG. 3, the bagging machine 20 includes rolls of gusseted tubing 42 and 44 formed from a heat-shrinkable film. The tubing in roll 42 has a larger diameter than the tubing in roll 44. Either the roll of large diameter tubing 42 or the roll of small diameter tubing 44 is used for forming a bag to cover a loaded pallet depending upon the peripheral dimensions of the pallet. The use of the two sizes of tubing permits a bag 24 to be formed for pallets having varying dimensions. A sensing mechanism, later detailed, is utilized for selecting the appropriate roll of large or small diameter tubing.

FIG. 3 illustrates the operation of the bagging machine 20 as a bag 24 is being formed from the roll 42 of large diameter tubing. The tubing from the rolls 42 and 44 is threaded to drive rollers 46 and 47 in the bagging machine 20. The drive rollers 46 and 47 are held together on the tubing by pneumatic cylinders 48 and 49, respectively. The cylinders 48 and 49 release the drive rollers 46 and 47 to permit threading of the tubing through the drive rollers when a new roll of tubing is being placed in the bagging machine. The roll of tubing 42 is fed by the drive roller 46 through a cut-and-seal mechanism 50 to the inclined vacuum belt units 40. The vacuum belt units 40 draw the sides of the tubing apart and feed the tubing downward onto the gathering arm assemblies 38. The gathering arm assemblies 38 are mounted on beams 60 that are mounted on the frame 52 of the bagging machine 20 for vertical movement to lower the bag 24 over the loaded pallet 22. A vacuum source 54 is provided on the bagging machine 20 to supply the vacuum belt units 40 with vacuum.

In the operation of the bagging machine 20, the roll of tubing 42 is fed into the vacuum belt units 40 and gathered on the gathering arm assemblies 38 until an appropriate length of bag is collected on the assemblies. The length of the bag being formed is controlled by the bag length sensor 41, as later detailed. The cut-and-seal mechanism 50 is then energized to cut the roll of tubing 42 and seal its end to complete formation of the bag 24.

The gathering arm assemblies 38 are than lowered and retracted outward to open the bag 24. As the gathering arm assemblies 38 continue downward, the bag 24 is unrolled off the gathering arm assemblies onto the loaded pallet 22. The lowering of the assemblies 38 continues until the bag 24 is completely over the loaded pallet 22. The covering of the loaded pallet 22 with the bag 24 is thus complete and the pallet can then be transferred to the discharge conveyor by the centering trolley 30.

The cut-and-seal mechanism 50 includes a movable knife 56 and clamping jaws 58. In the operation of the cut-and-seal mechanism 50, the jaws 58 are closed on the tubing and the knife 56 is operated to cut the tubing. The jaws 58 are then heated at the lower portion thereof to seal the end of the tubing and complete formation of the bag 24.

Figure 4:
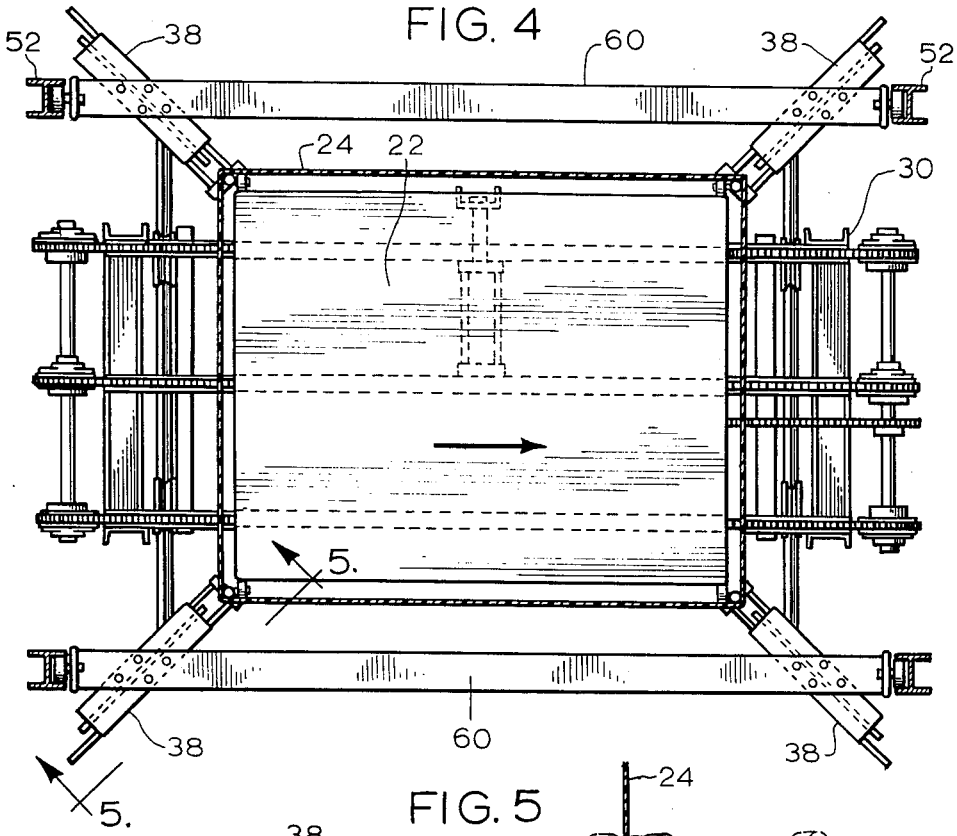
FIG. 4 is a sectional view of the bagging machine taken along line 4—4 in FIG. 3.

Referring to FIG. 4, the gathering arm assemblies 38 are arranged on diagonals of the loaded pallet 22 and are affixed to beams 60. The beams 60 are arranged to travel vertically along the frame 52 and thus lower the bag 24 collected on the gathering arm assemblies 38 over the loaded pallet 22.

Figure 5:
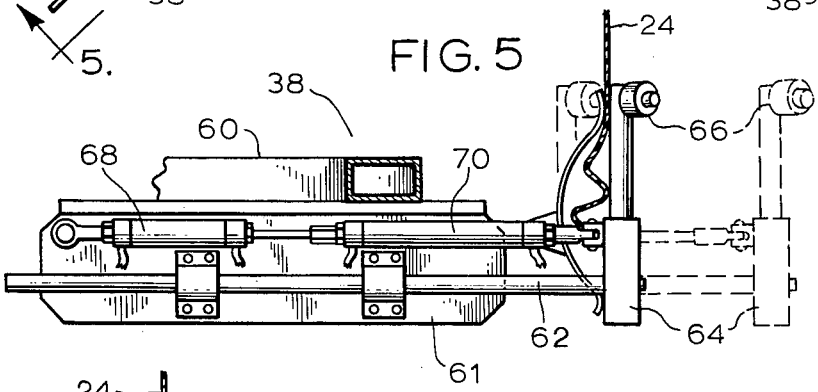
FIG. 5 is a view of the gathering arm assembly used in the bagging machine taken along line 5—5 of FIG. 4.
Figure 6:
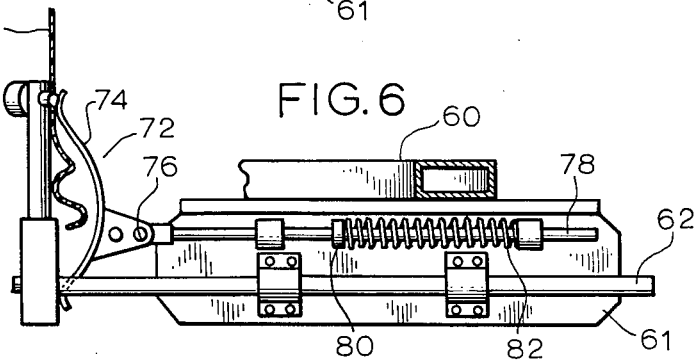
FIG. 6 is a rear view of the gathering arm assembly shown in FIG. 5.

Referring to FIGS. 5 and 6, one of the gathering arm assemblies 38 is illustrated. The gathering arm assembly 38 includes guide rods 62 that are slidably affixed to opposite sides of a body member 61 which is in turn affixed to the beam 60. An upright 64 is attached to one end of the guide rods 62 and has a roller 66 mounted on its upper end. Pneumatic cylinders 68 and 70 are provided for laterally positioning the upright 64 diagonally along the bagging machine.

When both of the cylinders 68 and 70 are extended, the roller 66 of the upright 64 on the gathering arm assembly 38 is in position against the inclined vacuum belt unit 40. Thus, the gathering arm assembly is in position for collecting the walls of the bag 24. Collapsing the pneumatic cylinder 70 retracts the upright 64 into position for lowering a small diameter bag over a loaded pallet 22. However, if a large diameter bag is being utilized, both the pneumatic cylinders 68 and 70 are collapsed and the upright 64 is retracted to the leftmost position for lowering over a pallet.

The gathering arm assembly 38 includes a retainer assembly 72 to assure that the bag 24 collected outside the upright 64 is fed out evenly as the gathering arm assembly 38 is lowered over the loaded pallet 22. The retainer assembly 72 includes a plate 74 that is connected by a pivot 76 to a rod 78. The rod 78 is slidably mounted on the body 61 and has a shoulder 80 for engaging a spring 82 disposed on the rod. The spring 82 serves as a biasing means for urging the plate 74 against the upright 64 when the upright is in either of the two retracted positions. It will be appreciated that biasing means other than the spring 82 can be utilized for urging the plate 74 against the upright 64.

When the upright 64 is in a fully extended position and engaging the vacuum belt units 40, the plate 74 remains clear of the upright 64. In the extended position, the bag 24 is collected around the upright 64 without interference from the retainer assembly 72. When the upright 64 is retracted to either of the two positions for the large or small diameter bags, the plate 74 engages the upright and presses the wall of the bag 24 against the upright. As the gathering arm 38 is lowered, the bag 24 is withdrawn evenly between the plate 74 and the upright 64. In the absence of the retainer assembly 72, entire folds of the bag 24 may be drawn off the gathering arm assembly 38 with resultant uneven removal of the bag 24.

Referring to FIG. 7, the driving linkages for the bagging machine 20 are illustrated. With the exception of the drive for the gathering arm assembly 38, all the mechanisms in the bagging machine 20 are linked together with drive chains powered by a main drive motor unit 84. The use of a single main drive unit to power the mechanisms in the bagging machine 20 through direct linkages results in mechanical synchronization of the mechanisms during the time when the bag 24 is being formed and collected on the gathering arm assembly 38.

A gathering arm drive motor unit 86 is used for lowering the gathering arm assemblies 38 and placing the bag 24 over the loaded pallet 22. The drive motor unit 86 utilizes a reversible motor and reversing the operation of the motor raises the gathering arm assemblies 38. The motor unit 86 supplies power to drive chains 88 and 90 which are coupled to the respective ends of the beam 60. Movement of the chains 88 and 90 causes the beam 60 to be moved vertically within the frame 52. The transfer shafts 92 located at each end of the machine extend to the rear of the machine where chains similar to the chains 88 and 90 raise the beam 60 located at the rear of the machine.

The main drive unit 84 supplies power to a main drive chain 94. The main drive chain 94 supplies power through a transfer unit 96 to a roller drive chain 98. The roller drive chain is coupled to the drive rollers 46 and 47 through clutches **46*a* and 47*a*, respectively. The main drive chain 94 also supplies power to the upper drive shafts 100 of the vacuum belt unit 40. The feed rates of the drive rollers 46 and 47 are adjusted with appropriate gearing to equal the feed rate achieved by the vacuum belt units 40**.

A belt drive chain 102 transfers power from the upper drive shaft 100 to a lower drive shaft 104 on the belt unit 40. The lower drive shaft 104 on the belt unit 40 transfers power through a clutch **106*a* to a sensor drive chain 106. The sensor drive chain 106 operates to raise the bag length sensor 41**, as detailed.

A length programming chain 108 is affixed to a connecting link 110 on the centering trolley 30. As the centering trolley 30 moves between the longitudinal center line of the machine and the longitudinal center line of the loaded pallet, the programming chain 108 is moved by the connecting link 110. The movement of the programming chain 108 rotates the shaft 112 which is coupled through a clutch **108*a* to the sensor drive chain 106**.

The length of tubing to form the bag 24 that is necessary to cover a loaded pallet is determined by the size of the loaded pallet. The length of tubing required is equal to one-half the width across the top of the loaded pallet, plus the height of the loaded pallet, plus any necessary overlap to form a skirt of the bag around the loaded pallet, if desired. The sensor drive chain 106 is driven when one of the drive rollers 46 and 47 is being driven to feed tubing to the vacuum belt 40.

A sensor dog 114 is attached to the sensor drive chain 106 for engaging the bag length sensor 41 and raising the sensor vertically as the chain 106 is driven. The sensor dog 114 is positioned at a pre-load distance from the bag length sensor 41 at a distance equal to one-half the width of the loaded pallet plus any skirt overhang on the pallet. The preset distance of the sensor dog 114 is controlled by the programming chain 108 during centering of the loaded pallet.

The sensor drive chain 106 continues operating and one of the drive rollers continues feeding tubing until the bag length sensor 41 reaches the top of the loaded pallet. The sensor 41 then stops the main drive unit 84. At this point, sufficient tubing has been fed through one of the drive rollers 46 and 47 to form the necessary length of bag. The cut-and-seal mechanism 50 is then operated and the formation of the bag is completed.

Originally, the sensor drive chain 106 is set to a home position by a homing dog 116 engaging a limit switch 118. In this position, the sensor dog 114 is at a distance from the bag length sensor 41 equal to half the width of the largest pallet plus any desired skirt overhang of the bag 24. When the centering trolley 30 returns from the longitudinal center line of the loaded pallet to the longitudinal center line of the machine, the clutch **108*a* is engaged, while the clutch 106*a* is disengaged, and the programming chain 108 moves the sensor drive chain 106 forward an amount equal to the difference between the half width of the pallet being loaded and the half width of the largest pallet. Thus, the programming chain 108 and associated mechanisms serve to set the half width of the pallet being loaded into the sensor drive chain 106 for use as a pre-load to the length sensor 41**.

A main pulley 120 is connected to the centering trolley 30 and engages a cable 122. The cable 122 is also connected around pickup pulleys 124 and to anchors 125. A support bar 126 is connected to the cable 122 for movement with the cable. The side sensor 36 is positioned on the top of the support bar 126. Due to the effect of the main pulley 120 as the centering trolley 30 travels toward the center line of a loaded pallet, the side sensor 36 moves toward the side of a loaded pallet at twice the rate of the centering trolley 30.

In order to understand the operation of the side sensor 36 and trolley 30, assume that a loaded pallet of a large width is being presented to the centering trolley 30. In this case, the longitudinal center lines of the pallet and the trolley coincide and the side sensor 36 is located against the side of the loaded pallet. When a pallet having a smaller width is presented to the bagging machine 20, the side of the smaller pallet will be, for example, 6 inches away from the side sensor 36. However, the longitudinal center lines of the trolley 30 and the smaller pallet are only 3 inches apart. Since the side sensor 36 travels twice the distance of the trolley 30, when the side sensor 36 contacts the side of the smaller pallet, the center lines of the trolley and the pallet will coincide.

Referring to FIG. 8, the bag length sensor 41 includes a photocell 128 positioned on the sensor body 130. The sensor body 130 has a grooved portion 132 for receiving the sensor drive chain 106 and associated sensor dog 114. A lever 136 is pivotally attached to the sensor body 130 and biased against the sensor chain 106 by a spring 136. The sensor dog 114 travels into the grooved portion 132 of the sensor body and engages the lever 136. The strength of the spring 137 is sufficient to hold the lever 136 against the chain 106 and the sensor dog 114 carries the bag length sensor 41 upward after the lever 136 is engaged.

Referring to FIG. 9, the bag length sensor 41 is disposed on parallel guide rods 138. During the operation of the sensor, drive chain 106 and the sensor dog 114 continue to travel with the chain 106 and raise the bag length sensor 41 until the sensor hits the upper stop 140. The dog 114 continues to travel upward and pivots the lever 136 away, thereby releasing the bag length sensor 41. The bag length sensor 41 falls downward along the parallel guide rods 138 until it comes to rest on the lower stop 142. Counterweights (not shown) can be connected to the bag length sensor 41 to prevent the sensor from striking the lower stop 142 with too great a force. Additionally, a damper can be associated with the lower stop 142, if desired, to absorb energy from the falling sensor 41.

The operation of the driving mechanism in the bagging machine 20 will now be described. Initially, the sensor drive chain 106 is positioned with the homing dog 116 within the limit switch 118. The centering trolley 30 is moved by pneumatic cylinder 144 into alignment with the longitudinal center line of the pallet to be covered as indicated by the side sensor 36. The pallet is placed on the centering trolley 30 and the trolley is returned to the longitudinal center line of the machine. During the return of the trolley, the programming chain 108 moves the sensor drive chain 106 forward to the appropriate pre-load length setting for the size of the pallet.

After the centering trolley 30 returns to the home position with the pallet properly centered in the machine, the main drive unit 34 is started. As a consequence, one of the drive rollers, for example drive roller 46, is driven by clutch **46*a* and the vacuum belt units 40 are driven by the main drive chain 94. Additionally, the clutch 106*a* is engaged and the sensor drive 106 is driven. The tubing for forming the bag 24 is fed to the vacuum belt units 40 which open the tubing and collect it on the gathering arm assemblies 38. The sensor drive chain 106 moves at the same speed as the vacuum belt units 40** during the bag forming step.

As the forming step continues, the sensor dog 114 on the sensor drive chain 106 engages the bag length sensor 41 and raises the sensor vertically along the loaded pallet 22. When the top of the loaded pallet is sensed by the sensor 41, the main drive unit 84 is stopped. The cut-and-seal mechanism 50 is then operated and the formation of the bag 24 is completed. The main drive unit 84 is again started with both the drive rollers 46 and 47 being disengaged by the clutches **46*a* and 47*a*. Under the power of the main drive unit, the vacuum belt units 40 continue feeding the bag 24 onto the gathering arms 38 and the bag length sensor 31 is raised until it strikes the upper stop 140. The sensor dog 114 then releases the sensor 41 and it falls to the lower stop 142. The main drive unit 84 continues operation until the housing dog 116 activates the limit switch 118 thereby stopping the drive unit 84**.

The sensor dog 114 and the homing dog 116 are arranged on opposite sides of the sensor drive chain 106. As a result, the housing dog 116 does not act on sensor 41 and the sensor dog 114 does not act on the limit switch 118.

The gathering arm drive unit 86 is next energized and the gathering arm assemblies are lowered. At the same time, the gathering arm assemblies 38 are retracted outward. The lowering of the gathering arm assemblies 38 continues until the lower limit of travel is reached. At this point, the bag 24 is in place over the loaded pallet and the pallet is transferred to the discharge conveyor by the trolley 30. The gathering arm drive unit 86 is then reversed to raise the gathering arm assemblies 38 back to their upper position. As the gathering arm assemblies 38 are raised, the assemblies are extended for movement into position against the vacuum belt units 40.

Figure 12:
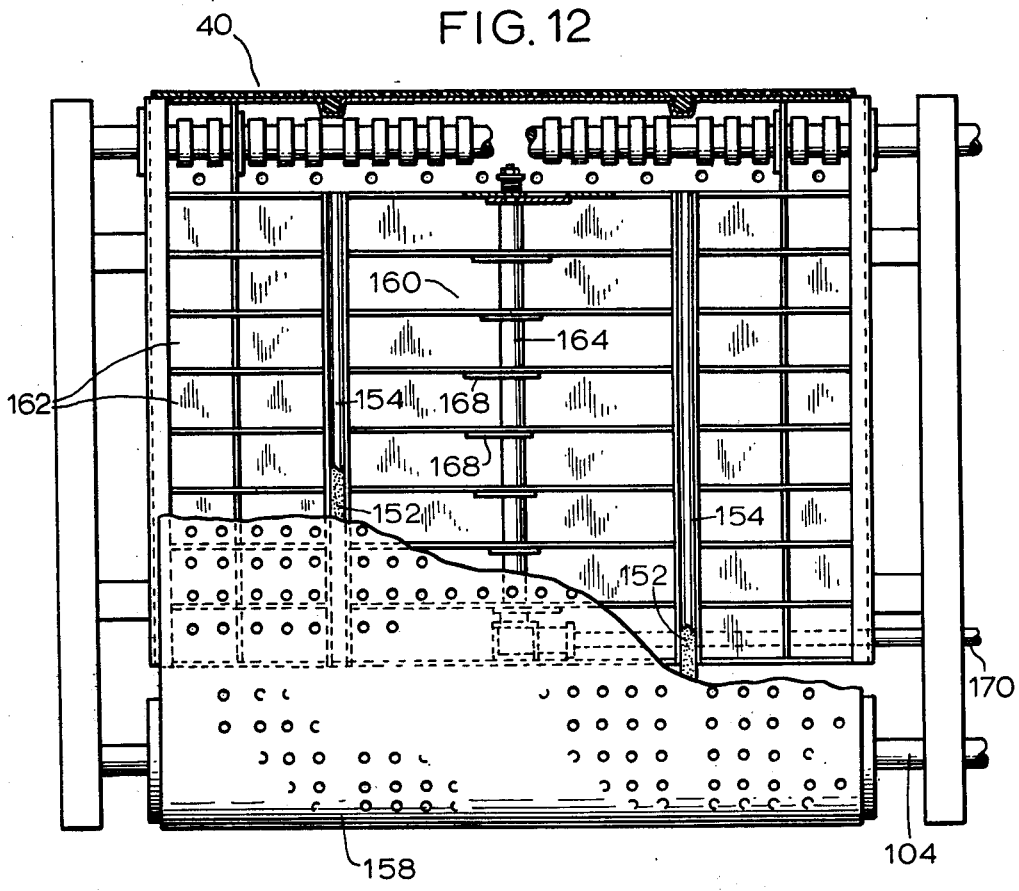
FIG. 12 is a sectional, cut-away view of the vacuum belt unit taken along line 12—12 in FIG. 10.

Referring to FIGS. 10, 11 and 12, the vacuum belt units 40 include perforated belts 146 that extend around the drive shafts 102 and 104 and guide rollers 148. The vacuum belt units 40 are inclined at approximately a 45° angle with the perforated belts 146 forming a jaw area 150 for receiving the tubing used in forming a bag. The perforated belts 146 engage the tubing and pull the sides of the tubing apart. The tubing is then fed downward by the perforated belts 146 and collects on the gathering arm assemblies 38.

The perforated belt 146 preferably has aligning strips 152 bonded to the interior of the belt. The aligning strips 152 engage grooved slides 154 and operate to keep the belt positioned on the drive shaft 102 and 104. However, it will be appreciated that other forms of aligning means can be used to keep the perforated belt 146 positioned on the drive shafts 102 and 104.

Referring to FIG. 10, a vacuum supply manifold 156 supplies a vacuum to a vacuum chamber 158 in the belt unit 40. The vacuum chamber 158 is divided into a plurality of central chambers 160 and side chamber 162.

A valve shaft 164 extends the length of the vacuum chamber 158 through the central chambers 160. Each of the central chambers 160 has an aperture 166 to communicate with the adjacent chamber 160. The valve shaft 164 has a plurality of valve blades 168 affixed at angularly offset positions of equal increments around the shaft adjacent the apertures 166. The valve blade 168 is dimensioned to cover the aperture 166 between the chambers 160. Referring to FIG. 12, a valve drive shaft 170 is used for powering the valve shaft 164. The valve drive shaft 170 is coupled through a clutch (not shown) to the belt drive shaft 100.

The speed of rotation of the valve shaft 160 is synchronized so that the valve blades 168 will uncover the central chambers 160 in sequence down the vacuum chamber 158 as the tubing being used to form the bag 24 passes by the central chambers 160. Once all the valve blades 168 are fully opened and vacuum is being supplied to all central chambers 160, the clutch (not shown) driving the shaft 170 is disengaged and the valve shaft 164 remains stationary.

The sequential opening of the central chambers 160 by the valve shaft 164 prevents vacuum from being lost in the central chambers downstream from the tubing which are not covered by the tubing. In the absence of the sequential valving, the uncovered downstream chambers would lose a considerable amount of vacuum. However, once a chamber is covered by the tubing, little vacuum loss occurs. Thus, the sequential opening of the central chambers 160 as the tubing travels along the chambers conserves vacuum within the vacuum chamber 40.

When the small diameter tubing is being utilized to form a bag 24, the small diameter tubing only extends across the central chambers 160 of the vacuum chamber 158. Thus, vacuum is being lost in the side chambers 162. However, when the large diameter tubing 42 is being utilized to form a bag 24, both the side chambers 162 and the central chambers 160 are covered by the tubing. Therefore, side chamber valves 170 can be utilized to isolate the central chambers 160 from the side chambers 162 when a small diameter of tubing is being utilized. It has been discovered that the amount of vacuum lost in the side chambers 162, when compared to the central chambers 160, is not nearly so great. Therefore, the vacuum belt unit 40 can be satisfactorily operated without the use of the side valves 170, without a large vacuum loss.

The lower portion of the jaws 58 in the cut-and-seal mechanism 50 includes heating elements 172 for sealing the end of the bag 24. After a bag 24 has been completely formed by the cut-and-seal mechanism 50, the top of the bag passes through the jaws 150 formed between the vacuum belt units 40. As the end of the bag 24 passes down the belt units 40, the vacuum gripping against the sides of the bag 24 is lost and the center of the bag falls downward. However, the rollers 66 in the gathering arm assemblies 38 press the bag 24 against the perforated belts 146 and causes the bag 24 to be fed downward onto the gathering arms 38 until the end of the bag is taut between the rollers 66.

Referring to FIG. 13, the centering trolley includes a conveyor drive motor unit 174 that is coupled to a conveyor drive shaft 176. The conveyor drive shaft 176 operates the conveyor chains 178. The conveyor chains 178 are used to transfer a loaded pallet from the entrance conveyor 26 onto the trolley 30 and also for transferring a pallet from the trolley 30 to the discharge conveyor 32. A pneumatic cylinder 144 is used for displacing the trolley 30 until the longitudinal center line of the trolley coincides with the longitudinal center line of the pallet being loaded, as previously detailed. The trolley 30 travels on grooved wheels 180 that engage V-shaped guide rails 182.

Referring to FIGS. 14*a*, 14*b* and 14*c*, the operation of the centering trolley 30 in transferring a pallet onto the trolley into a position where the lateral center line of the pallet is in alignment with the lateral center line of the machine to center the load lengthwise on the trolley is illustrated. The length centering mechanism includes a length sensor 184 that is affixed to a control chain 186.

Initially, prior to the transfer of a pallet onto the trolley 30, the control chain 186 is in the home position shown in FIG. 14*b*. Preferably, the control chain 186 is set to the home position when the pneumatic cylinder 144 is extended. In order to transfer the pallet 22 onto the trolley 30 once the longitudinal center lines of the pallet and the trolley are aligned, the conveyor chains 178 are energized and the loaded pallet 22 is moved onto the trolley. The lower edge of the loaded pallet 22 will engage the control dog 188 and begin to move the control chain 186 in a clockwise direction. As a result, the length sensor 184 is moved to the left by an amount equal to the rightward movement of the control dog 188. When the length sensor 184 senses the rear of the loaded pallet 22, the movement of the conveyor chains 178 is stopped, and the loaded pallet 22 is aligned with the lateral center line of the machine, as shown in FIG. 14*c*.

In the home position of the control chain 186, as shown in FIG. 14*b*, the control dog 188 is within the limit of the smallest pallet length which is to be used in the bagging machine 20. Thus, even the smallest length pallet 22 will engage the control dog 188 and move the control chain 186 until the centered position, shown in FIG. 14*c*, is achieved.

After the loaded pallet 22 is centered on the trolley, as shown in FIG. 14*c*, the pneumatic cylinder 144 is collapsed to retract the centering trolley to the center of the bagging machine. Also, the control chain 186 is moved in a clockwise direction to the retracted position shown in FIG. 14*a*. In the retracted position, the loaded pallet 22 can be transferred from the trolley 30 onto the discharge conveyor without hitting the control dog 188.

Referring to FIG. 15, the length sensor 184 is slidably mounted on a pair of parallel guide rods 190. The length sensor 184 is coupled to a pneumatic cylinder 192 which positions the sensor and associated control chain 186 in the retracted position shown in FIG. 14*a*, and the home position shown in FIG. 14*b*. At other times, no pressure is applied to the cylinder and the length sensor is free to move on the guide rods.

The length sensor 184 includes a photocell 194 for sensing the rear of a pallet 22 and a cam follower unit 196. The cam follower unit 196 is activated by cams 198 and 200 that are positioned on a cam rail 202. The position of the cam follower 196, when the loaded pallet 22 is in a centered position, is indicative of the length of the loaded pallet. Generally, if the length of a loaded pallet is known, the diameter of tubing necessary for that loaded pallet can be determined. This results from the fact that in most applications for a pallet of any given length, there generally is only a single width or the widths do not differ greatly. Thus, the length of the loaded pallet can be used to determine whether the small or large tubing is to be used in making the bag 24. Thus, in the present application, when the cam follower is positioned on the cam rail 202, a small diameter tube is used to form the bag 24. However, when the cam follower unit 196 is positioned on the cam 198 or 200, the large diameter tubing is utilized for forming the bag 24. The cam 200 represents a pallet having a large width for its length, such as a square pallet. Other pallets having longer lengths to the left of cam 200 have narrower widths and therefore still utilize a small diameter tubing. The cam 198 represents other pallets having a length which requires large diameter tubing for forming the bag.

It will be appreciated that if pallets having widely varying widths for a given length are being used, a sensing mechanism can be used to determine the width of the pallet. Thus, the indication of the width sensor and the length sensor can be combined to determine whether a large or small diameter tubing is necessary.

It is to be understood that various modifications can be made to the disclosed bagging machine without departing from the scope of the invention, and it is intended to cover in the appended claims all such modifications as fall within the true spirit and scope of the invention.

What is claimed is:

1. A bagging machine for covering a load with a bag formed from a tubing of stock material comprising:

means for feeding the tubing to a work area for receiving the tubing;

means for gripping the tubing, and spreading the tubing to an at least partially open position;

gathering arm means for collecting in collapsed condition the tubing which has been spread to an open position, said gathering arm means including means for positively feeding the tubing onto said gathering arm means;

means for retracting the gathering arm means outward to spread the collected bag on the gathering arm means to a size sufficient to encompass the load;

means for severing the tubing and forming the bag therefrom, the bag being collected on said gathering arm means; and means for providing relative movement between said gathering arm means and the load in order to feed the bag from said gathering arm means so as to cover the load.

2. The bagging machine of claim 1 wherein said means for gripping and spreading the tubing comprises vacuum means.

3. The bagging machine of claim 2 wherein the gathering arm means includes means for retaining the bag collected on the gathering arm means as relative movement is effected between the gathering arm means and the load, and the bag is fed onto the load.

4. The bagging machine of claim 2 wherein the means for positively feeding the tubing onto said gathering arm means comprises roller means.

5. The bagging machine of claim 2 wherein said means for positively feeding the tubing onto said gathering arm means comprises rollers which may be biased against said vacuum means so that as said vacuum means spreads the tubing to an open position, the tubing is being positively fed onto said gathering arm.

6. A bagging machine for covering a load with a bag formed from a tubing of stock material comprising:

means for feeding the tubing to a work area for receiving the tubing;

vacuum means for gripping the tubing, and spreading the tubing to an at least partially open position;

gathering arm means for collecting the tubing in collapsed condition, said gathering arm means receiving tubing from said vacuum means;

means associated with said gathering arm means for positively feeding the tubing onto said gathering arm means from said vacuum means which has spread open the tubing;

means for retracting the gathering arm means outward to stretch the collected bag on the gathering arm means;

means for severing the tubing and forming the bag therefrom, the bag being collected on said gathering arm means; and means for providing relative verticle movement between said gathering arm means and the load in order to feed the bag from said gathering arm means so as to cover the load.

7. The bagging machine of claim 6 wherein the means for positively feeding the tubing comprises roller means.

8. The bagging machine of claim 6 wherein the gathering arm means includes means for retaining the bag collected on the gathering arm means as relative movement is effected between said gathering arm means and the load, and the bag is fed onto the load.

9. The bagging machine of claim 6 wherein said vacuum means comprises vacuum belts and said means for positively feeding the tubing onto said gathering arm means comprises rollers which are adapted to engage said vacuum belts as the tubing is being spread open so that the tubing is positively fed between said rollers and said vacuum belts onto said gathering arm means.

* * * * *